US006112635A

United States Patent [19]

Cohen

[11] Patent Number: 6,112,635

[45] **Date of Patent: *Sep. 5, 2000**

[54] COMPOSITE ARMOR PANEL

[75] Inventor: Michael Cohen, Mobile Post North Yehuda, Israel

[73] Assignee: Mofet Etzion, Israel

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/048,628

[22] Filed: Mar. 26, 1998

Related U.S. Application Data

[63] Continuation-in-part of application No. 08/704,432, Aug. 26, 1996, Pat. No. 5,763,813.

[51] Int. Cl.[7] ..... F41H 5/04

[52] U.S. Cl. ..... 89/36.02; 428/911

[58] Field of Search ..... 89/36.01, 36.02; 109/82, 83, 84; 428/911

[56] References Cited

U.S. PATENT DOCUMENTS

| | | | |
|---|---|---|---|
| 3,523,057 | 8/1970 | Buck | 89/36.02 |
| 3,705,558 | 12/1972 | McDougal et al. | 109/84 |
| 4,061,815 | 12/1977 | Poole, Jr. | 428/312 |
| 4,131,053 | 12/1978 | Ferguson | 109/82 |
| 4,179,979 | 12/1979 | Cook et al. | 109/49.5 |
| 4,602,385 | 7/1986 | Warren | 2/2 |
| 5,134,725 | 8/1992 | Yeshurun et al. | 428/911 |
| 5,361,678 | 11/1994 | Roopchand et al. | 89/36.02 |
| 5,763,813 | 6/1998 | Cohen et al. | 89/36.02 |

FOREIGN PATENT DOCUMENTS

| | | |
|---|---|---|
| 0 499 812 A1 | 8/1992 | European Pat. Off. . |
| 816814 | 8/1937 | France . |
| 1566448 | 5/1969 | France . |
| 2559254 | 8/1985 | France . |
| 2 711 782 A1 | 5/1995 | France . |
| 2711782 | 5/1995 | France . |

(List continued on next page.)

OTHER PUBLICATIONS

International Search report (2 pgs) conducted by the European Patent Office; File No. RS 96807; dated Jun. 27, 1996.

International Search report (2 pgs) conducted by the European Patent Office; dated May 14, 1998, Related to EP 98 30 1769.

Plasan Sasa Plastic Products, Price List, Mar. 31, 1998.

Coors Porcelain Company Brochure, 1 page.

Ballistic Materials and Penetration Mechanics, Chapter 6, Roy C. Laible, pp. 135–142, 1980.

14th International Symposium on Ballistics, Quebec, Canada, The Performance of Lightweight Ceramic Faced Armours Under Ballistic Impact, Drs. C. Navarro, M.A. Martinez, R. Cortes and V.Sanchez–Galvez, pp. 573–577, Sep. 1993.

Coors Ceramic Company, Armor Products Brochure, Coors Alumina Armor Materials, Data Sheet 52–96, 2 pages, 1990.

Alumina, Processing, Properties and Applications, E. Dorre & H. Hubner, pp. 278–283, 1984.

Rafael, System Concept of Applique Flexible Ceramic Armor (FCA), Technical Proposal, pp. 3–41, Jun. 1993.

*Primary Examiner*—Stephen M. Johnson

*Attorney, Agent, or Firm*—Fulbright & Jaworski L.L.P.

[57] ABSTRACT

The invention provides a composite armor plate for absorbing and dissipating kinetic energy from high velocity, armor-piercing projectiles, the plate comprising a single internal layer of high density ceramic pellets which are directly bound and retained in plate form by a solidified material such that the pellets are bound in a plurality of adjacent rows, characterized in that the pellets have an $Al_2O_3$ content of at least 93% and a specific gravity of at least 2.5, the majority of the pellets each have at least one axis of at least 12 mm length and are bound by the solidified material in a single internal layer of adjacent rows, wherein a majority of each of the pellets is in direct contact with at least 4 adjacent pellets, and the solidified material and the plate are elastic.

16 Claims, 3 Drawing Sheets

FOREIGN PATENT DOCUMENTS

| | | |
|---|---|---|
| 101437 | 9/1897 | Germany . |
| 1578324 | 1/1970 | Germany . |
| 2815582 | 3/1980 | Germany . |
| 32 28 264 A1 | 12/1985 | Germany . |
| 3 507 216 A1 | 9/1986 | Germany . |
| 39 38 741 A1 | 3/1991 | Germany . |
| 1081464 | 8/1967 | United Kingdom . |
| 1142689 | 2/1969 | United Kingdom . |
| 1352418 | 5/1974 | United Kingdom . |
| 2 190 077 | 11/1987 | United Kingdom . |
| 2272272 | 5/1994 | United Kingdom . |

FIG. 4
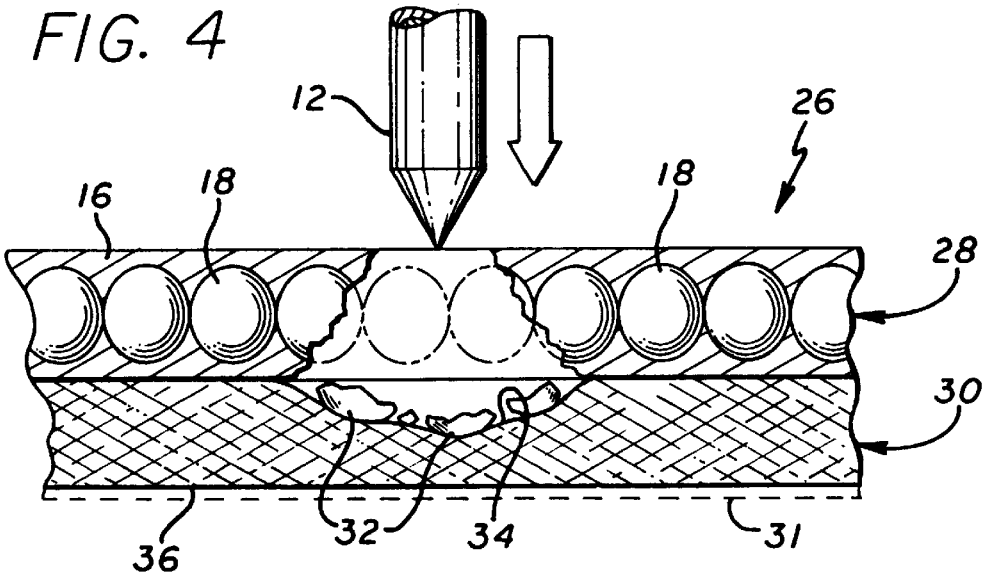
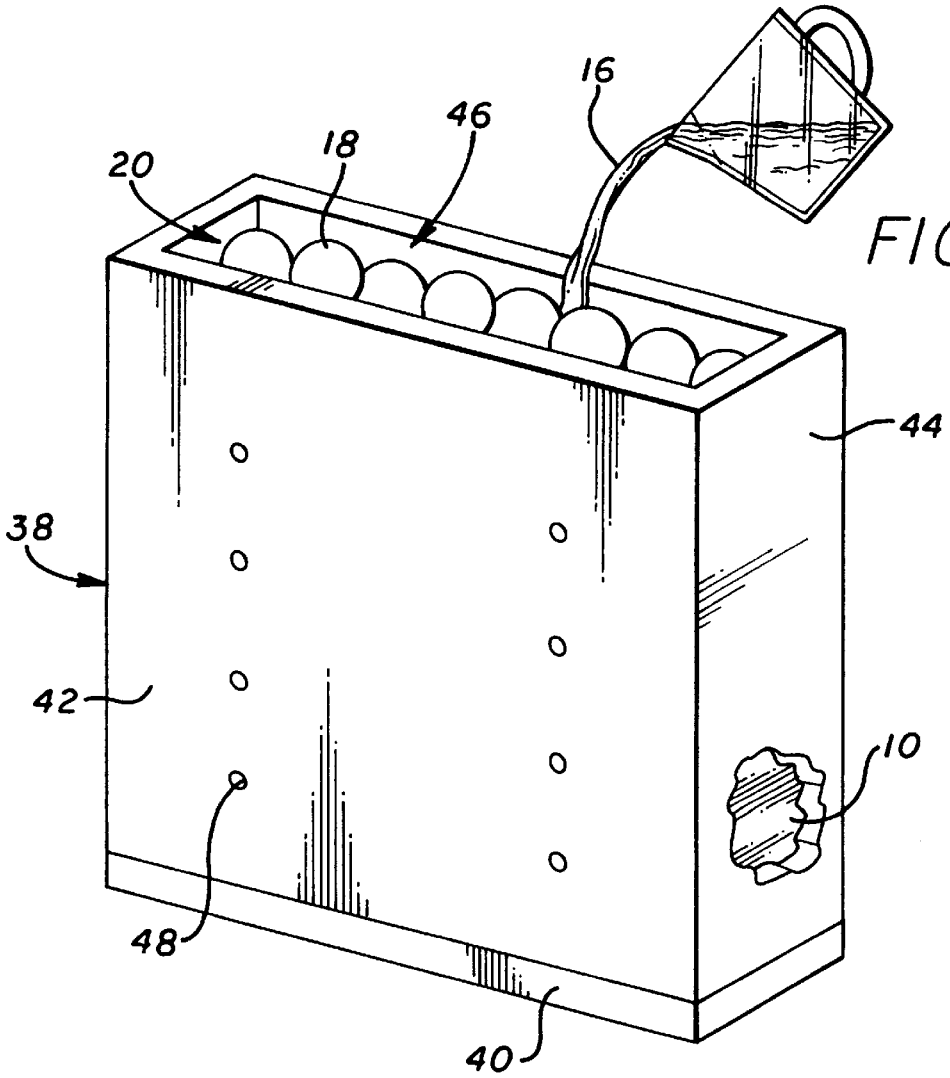
FIG. 5

FIG. 6
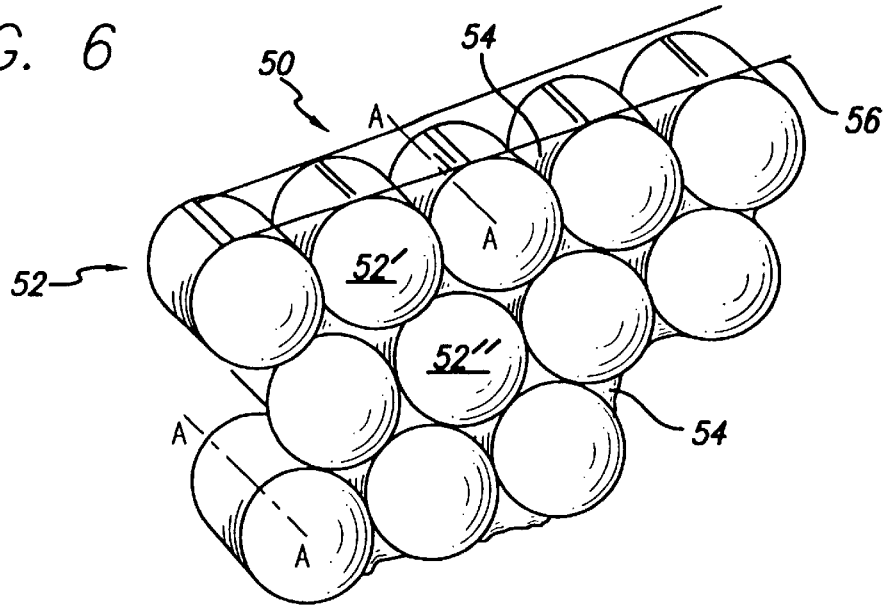
FIG. 7a
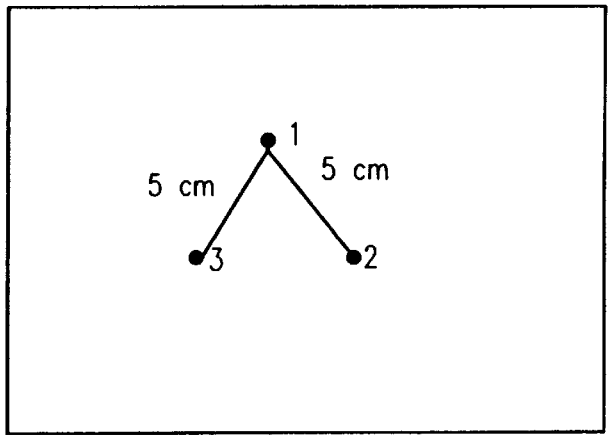
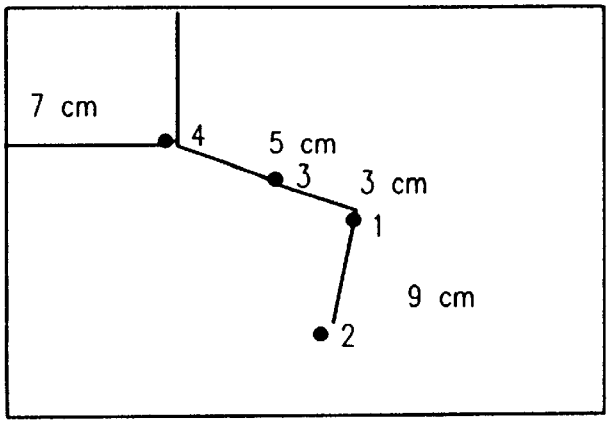
FIG. 7b

COMPOSITE ARMOR PANEL

The present specification is a continuation-in-part of U.S. Ser. No. 08/704,432 filed Aug. 26, 1996, now allowed U.S. Pat. No. 5,763,913.

The present invention relates to a composite armor panel. More particularly, the invention provides an armored panel providing ballistic protection for protecting light and heavy mobile equipment and vehicles against high-speed armor-piercing projectiles or fragments. The invention also includes methods for manufacturing the panel.

There are four main considerations concerning protective armor panels. The first consideration is weight. Protective armor for heavy but mobile military equipment, such as tanks and large ships, is known. Such armor usually comprises a thick layer of alloy steel, which is intended to provide protection against heavy and explosive projectiles. However, reduction of weight of armor, even in heavy equipment, is an advantage since it reduces the strain on all the components of the vehicle. Furthermore, such armor is quite unsuitable for light vehicles such as automobiles, jeeps, light boats, or aircraft, whose performance is compromised by steel panels having a thickness of more than a few millimeters, since each millimeter of steel adds a weight factor of 7.8 kg/m$^2$.

Armor for light vehicles is expected to prevent penetration of bullets of any type, even when impacting at a speed in the range of 700 to 1000 meters per second. However, due to weight constraints it is is difficult to protect light vehicles from high caliber armor-piercing projectiles, e.g. of 12.7 and 14.5 mm, since the weight of standard armor to withstand such projectile is such as to impede the mobility and performance of such vehicles.

A second consideration is cost. Overly complex armor arrangements, particularly those depending entirely on synthetic fibers, can be responsible for a notable proportion of the total vehicle cost, and can make its manufacture non-profitable.

A third consideration in armor design is compactness. A thick armor panel, including air spaces between its various layers, increases the target profile of the vehicle. In the case of civilian retrofitted armored automobiles which are outfitted with internal armor, there is simply no room for a thick panel in most of the areas requiring protection.

A fourth consideration relates to ceramic plates used for personal and light vehicle armor, which plates have been found to be vulnerable to damage from mechanical impacts caused by rocks, falls, etc.

Fairly recent examples of armor systems are described in U.S. Pat. No. 4,836,084, disclosing an armor plate composite including a supporting plate consisting of an open honeycomb structure of aluminium; and U.S. Pat. No. 4,868,040, disclosing an antiballistic composite armor including a shock-absorbing layer. Also of interest is U.S. Pat. No. 4,529,640, disclosing spaced armor including a hexagonal honeycomb core member.

Other armor plate panels are disclosed, e.g., in British Patents 1,081,464; 1,352,418; 2,272,272, and in U.S. Pat. No. 4,061,815 wherein the use of sintered refractory material, as well as the use of ceramic materials, are described.

Ceramic materials are nonmetallic, inorganic solids having a crystalline or glassy structure, and have many useful physical properties, including resistance to heat, abrasion and compression, high rigidity, low weight in comparison with steel, and outstanding chemical stabiity. Such properties have long drawn the attention of armor designers, and solid ceramic plates, in thicknesses ranging from 3 mm. for personal protection to 50 mm. for heavy military vehicles, are commercially available for such use.

Much research has been devoted to improving the low tensile and low flexible strength and poor fracture toughness of ceramic materials; however, these remain the major drawbacks to the use of ceramic plates and other large components which can crack and/or shatter in response to the shock of an incoming projectile.

Light-weight, flexible armored articles of clothing have also been used for many decades, for personal protection against fire-arm projectiles and projectile splinters. Examples of this type of armor are found in U.S. Pat. No. 4,090,005. Such clothing is certainly valuable against low-energy projectiles, such as those fired from a distance of several hundred meters, but fails to protect the wearer against high-velocity projectiles originating at closer range and especially does not protect against armor-piercing projectiles. If made to provide such protection, the weight and/or cost of such clothing discourages its use. A further known problem with such clothing is that even when it succeeds in stopping a projectile the user may suffer injury due to indentation of the vest into the body, caused by too small a body area being impacted and required to absorb the energy of a bullet.

A common problem with prior art ceramic armor concerns damage inflicted on the armor structure by a first projectile, whether stopped or penetrating. Such damage weakens the armor panel, and so allows penetration of a following projectile, impacting within a few centimeters of the first.

The present invention is therefore intended to obviate the disadvantages of prior art ceramic armor, and to provide an armor panel which is effective against a full range of armor-piercing projectiles from 5.56 mm and even up to 30 mm, as well as from normal small-caliber fire-arm projectiles, yet is of light weight, i.e, having a weight of less than 45 kg/m$^2$ for personal armor and light weight vehicles and having a weight of less than 185 kg/m$^2$, even for the heavier armor provided by the present invention for dealing with 25 and 30 mm projectiles.

A further object of the invention is to provide an armor panel which is particularly effective in arresting a plurality of armor-piercing projectiles impacting upon the same general area of the panel.

The above objectives are achieved by providing a composite armor plate for absorbing and dissipating kinetic energy from high velocity, armor-piercing projectiles, said plate comprising a single internal layer of high density ceramic pellets which are directly bound and retained in plate form by a solidified material such that the pellets are bound in a plurality of adjacent rows, characterized in that the pellets have an $Al_2O_3$ content of at least 93% and a specific gravity of at least 2.5, the majority of the pellets each have at least one axis of at least 12 mm length and are bound by said solidified material in a single internal layer of adjacent rows, wherein a majority of each of said pellets is in direct contact with at least 4 adjacent pellets, and said solidified material and said plate are elastic.

In preferred embodiments of the present invention there is provided a composite armor plate as defined above, wherein the majority of said pellets each have at least one axis having a length in the range of from about 12 to 40 mm and the weight of said plate does not exceed 185 kg/m$^2$.

In especially preferred embodiments of the present invention, each of a majority of said pellets is in direct contact with at least six adjacent pellets.

Said solidified material can be any suitable material which retains elasticity upon hardening at the thickness used, such as aluminum, epoxy, a thermoplastic polymer, or a thermoset plastic, thereby allowing curvature of the plate without cracking to match curved surfaces to be protected, including body surfaces, as well as elastic reaction of the plate to incoming projectiles to allow increased contact force between adjacent pellets at the point of impact.

In French Patent 2,711,782, there is described a steel panel reinforced with ceramic materials; however, due to the rigidity and lack of elasticity of the steel of said panel, said panel does not have the ability to deflect armor-piercing projectiles unless a thickness of about 8–9 mm of steel is used, which adds undesirable excessive weight to the panel.

It is further to be noted that the elasticity of the material used in preferred embodiments of the present invention serves, to a certain extent, to increase the probability that a projectile will simultaneously impact several pellets, thereby increasing the efficiency of the stopping power of the panel of the present invention.

In a further preferred embodiment of the invention, there is provided a multi-layered armor panel, comprising an outer, impact-receiving panel of composite armor plate as hereinbefore defined, for deforming and shattering an impacting high velocity, armor-piercing projectile; and an inner layer adjacent to said outer panel, comprising a second panel of elastic material for absorbing the remaining kinetic energy from said fragments. Said elastic material will be chosen according to cost and weight considerations and can be made of any suitable material, such as aluminum or woven textile material.

In especially preferred embodiments of the invention, there is provided a multi-layered armor panel, comprising an outer, impact-receiving panel of composite armor plate as hereinbefore defined, for deforming and shattering an impacting high velocity, armor-piercing projectile; and an inner layer adjacent to said outer panel, comprising a second panel of tough woven textile material for causing an asymmetric deformation of the remaining fragments of said projectile and for absorbing the remaining kinetic energy from said fragments, wherein said multi-layered panel is adapted to stop three projectiles fired sequentially at a triangular area of said multi-layered panel, wherein the height of said triangle is substantially equal to three times the axis of said pellets.

As described, e.g., in U.S. Pat. No. 5,361,678, composite armor plate comprising a mass of spherical ceramic balls distributed in an aluminum alloy matrix is known in the prior art. However, such prior art composite armor plate suffers from one or more serious disadvantages, making it difficult to manufacture and less than entirely suitable for the purpose of defeating metal projectiles. More particularly, in the armor plate described in said patent, the ceramic balls are coated with a binder material containing ceramic particles, the coating having a thickness of between 0.76 and 1.5 and being provided to help protect the ceramic cores from damage due to thermal shock when pouring the molten matrix material during manufacture of the plate. However, the coating serves to separate the harder ceramic cores of the balls from each other, and will act to dampen the moment of energy which is transffed and hence shared between the balls in response to an impact from a bullet or other projectile. Because of this and also because the material of the coating is inherently less hard than that of the ceramic cores, the stopping power of a plate constructed as described in said patent is not as good, weight for weight, as that of a plate in accordance with the present invention in which the hard ceramic pellets are in direct contact with adjacent pellets.

McDougal, et al. U.S. Pat. No. 3,705,558 discloses a lightweight armor plate comprising a layer of ceramic balls. The ceramic balls are in contact with each other and leave small gaps for entry of molten metal. In one embodiment, the ceramic balls are encased in a stainless steel wire screen; and in another embodiment, the composite armor is manufactured by adhering nickel-coated alumina spheres to an aluminum alloy plate by means of a polysulfide adhesive.

A composite armor plate as described in the McDougal, et al. patent is difficult to manufacture because the ceramic spheres may be damaged by thermal shock arising from molten metal contact. The ceramic spheres are also sometimes displaced during casting of molten metal into interstices between the spheres.

In order to mimimize such displacement, Huet U.S. Pat. Nos. 4,534,266 and 4,945,814 propose a network of interlinked metal shells to encase ceramic inserts during casting of molten metal. After the metal solidifies, the metal shells are incorporated into the composite armor. It has been determined, however, that such a network of interlinked metal shells substantially increases the overall weight of the armored panel and decreases the stopping power thereof.

It is further to be noted that McDougal suggests and teaches an array of ceramic balls disposed in contacting pyrimidal relationship, which arrangement also substantially increases the overall weight of the armored panel and decreases the stopping power thereof, due to a billiard-like effect upon impact.

In U.S. Pat. Nos. 3,523,057 and 5,134,725 there are described further armored panels incorporating ceramic balls; however, said panels are flexible and it has been found that the flexibility of said panels substantially reduces their stopping strength upon impact, since the force of impact itself causes a flexing of said panels and a reduction of the supporting effect of adjacent ceramic balls on the impacted ceramic ball. Furthermore, it will be noted that the teachings of U.S. Pat. No. 5,134,725 is limited to an armor plate having a plurality of constituent bodies of glass or ceramic material which are arranged in at least two superimposed layers, which arrangement is similar to that seen in McDougal (U.S. Pat. No. 3,705,558). In addition, reference to FIGS. 3 and 4 of said patent show that pellets of a first layer do not contact pellets of the same layer and are only in contact with pellets of an adjacent layer, which arrangement is contributory towards the weakening of the stopping strength of the panel of said patent due to flexing upon impact, as opposed to the panels of the present invention, wherein the direct contact between adjacent pellets causes an increase in contact force between pellets upon impact.

As will be realized, none of said prior art patents teaches or suggests the surprising and unexpected stopping power of a single layer of ceramic pellets in direct contact with each other which, as will be shown hereinafter, successfully prevents penetration of armor-piercing 14.5 mm calibre projectiles despite the relative light weight of the panel incorporating said pellets.

Thus, it has been found that the novel armor of the present invention traps incoming projectiles between several very hard ceramic pellets which are held in a single layer in rigid mutual abutting relationship. The relatively moderate size of the pellets ensures that the damage caused by a first projectile is localized and does not spread to adjoining areas, as in the case of ceramic pellets.

A major advantage of the novel approach provided by the present invention is that it enables the fabrication of different panels adapted to deal with different challenges, wherein e.g. smaller pellets can be used for personal armor and for meeting the challenge of 7.62 and 9 mm projectiles, while larger pellets can be used to deal with foreseen challenges presented by 14.5 mm, 25 mm and even 30 mm armor piercing projectiles.

Thus it was found that cylindrical pellets having a diameter of 12.7 mm and a height of between 9.5 and 11.6 mm were more than adequate to deal with projectiles of between 5.56 and 9 mm, when arranged in a panel according to the present invention.

Similarly and as demonstrated hereinafter, cylindrical pellets having a diameter of 19 mm and a height of between 22 and 26 mm, were more than adequate to deal with armor piercing 14.5 mm projectiles.

For heavy armored vehicles pellets having a diameter of 38 mm and a height of between 32 and 45 mm were found to be more than adequate to deal with 20, 25 and even 30 mm armor piercing projectiles when used in a multi-layered armor panel according to the present invention.

An incoming projectile may contact the pellet array in one of three ways:

1. Center contact. The impact allows the full volume of the pellet to participate in stopping the projectile, which cannot penetrate without pulverising the whole pellet, an energy-intensive task. The pellets used are either spheres or shapes approaching a spherical form or hexagonal in cross-section, and this form, when supported in a rigid matrix, has been found to be significantly better at resisting shattering than rectangular shapes.

2. Flank contact. The impact causes projectile yaw, thus making projectile arrest easier, as a larger frontal area is contacted, and not only the sharp nose of the projectile. The projectile is deflected sideways and needs to form for itself a large aperture to penetrate, thus allowing the armor to absorb the projectile energy.

3. Valley contact. The projectile is jammed, usually between the flanks of three pellets, all of which participate in projectile arrest. The high side forces applied to the pellets are resisted by the pellets adjacent thereto as held by the solid matrix, and penetration is prevented. A test was arranged using a 14.5 mm caliber B-32 projectile to achieve this particular contact mode, and theory confirmation was obtained that such a result is indeed obtained in practice.

During research and development for the present invention, the preparation of a plate-like composite casting was required, wherein ceramic pellets occupied a centre layer and cast aluminium completely embedded the pellets. When using molten metal the pellets would cool the molten metal, and furthermore, the required close pellet formation would be disturbed by the casting process. As mentioned above, this problem was encountered by McDougal in U.S. Pat. No. 3,705,558. An attempt to solve this problem was suggested by Huet in U.S. Pat. Nos. 4,534,266 and 4,945,814 and Roopchand, et al. in U.S. Pat. No. 5,361,678 suggested a further solution involving coating the ceramic bodies with a binder and ceramic particles, followed by the introduction of the molten metal into the die.

It is therefore a further object of the present invention to provide a method of manufacturing composite armor plate as described herein, without introducing non-essential and extraneous further components into the final panel.

Thus, the present invention provides a method for producing a composite armor plate as defined hereinabove, comprising providing a mold having a bottom, two major surfaces, two minor surfaces and an open top, wherein the distance between said two major surfaces is from about 1.1 to about 1.4 times the height of said pellets; inserting said pellets into said mold to form a plurality of superposed rows of pellets extending substantially along the entire distance between said minor side surfaces, and from said bottom substantially to said open top; incrementally heating said mold and the pellets contained therein to a temperature of at least 100° C. above the flow point of the material to be poured in the mold; pouring molten material into said mold to fill the same; allowing said molten material to solidify; and removing said composite armor plate from said mold.

The present invention also provides a method for producing a composite armor plate, comprising providing a mold having a bottom, two major surfaces, two minor surfaces and an open top, wherein the distance between said two major surfaces is from about 1.1 to 1.4 times the height of said pellets; inserting said pellets into said mold to form a plurality of superposed rows of pellets extending substantially along the entire distance between said minor side surfaces, and from said bottom substantially to said open top; pouring liquid epoxy resin into said mold to fill the same; allowing said epoxy to solidify; and removing said composite armor plate from said mold.

As will be realized, when preparing the composite armor plate of the present invention, said pellets do not necessarily have to be completely covered on both sides by said solidified material, and they can touch or even bulge from the outer surfaces of the formed panel.

Similarly, said epoxy can be applied by spraying onto pellets arranged in a horizontal mould, instead of being poured, as known per se in the art.

Further embodiments of the invention, including weight-critical armored clothing, will also be described further below.

The invention will now be described in connection with certain preferred embodiments with reference to the following illustrative figures so that it may be more fully understood.

With reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 4 is a sectional view of a two-layer embodiment of the armor panel;

FIG. 5 is a diagrammatic view of a mold used in the methods for manufacturing the panel;

FIG. 6 is a perspective view of a small section of a panel, wherein a castable material fills the voids between bodies; and FIGS. 7*a* and 7*b* illustrate projectile impact arrays on panels according to the present invention.

Figure 1:
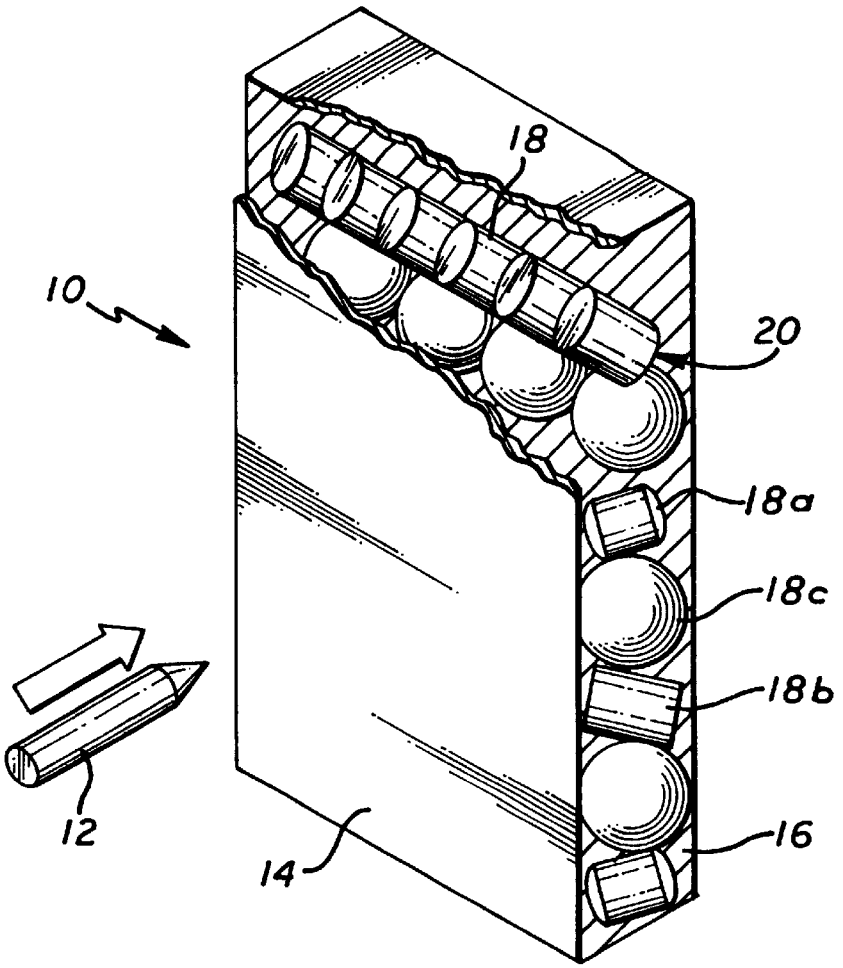
FIG. 1 is a perspective, fragmented view of a preferred embodiment of an armor panel according to the invention.

There is seen in FIG. 1 a composite armor plate 10 for absorbing and dissipating kinetic energy from high-velocity projectiles 12. A panel 14 is formed from a solidified material 16, the panel having an internal layer of high-density ceramic pellets 18. The outer faces of the panel are formed from the solidified material 16, and pellets 18 are embedded therein. The nature of the solidified material 16 is selected in accordance with the weight, performance and cost considerations applicable to the intended use of the armor.

Armor for land and sea vehicles is suitably made using a metal casting alloy containing at least 80% aluminum. A suitable alloy is Aluminum Association No. 535.0, which combines a high tensile strength of 35,000 kg/in$^2$, with excellent ductility, having 9% elongation. Further suitable alloys are of the type containing 5% silicon B443.0. These alloys are easy to cast in thin sections; their poor machinability is of little concern in the application of the present invention. An epoxy or other plastic or polymeric material, advantageously fiber-reinforced, is also suitable.

Pellets 18 have an alumina ($Al_2O_3$) content of at least 93%, and have a hardness of 9 on the Mohs scale. Regarding size, the majority of pellets have a major axis in the range of from about 1240 mm, the preferred range being from 20–30 mm.

There are shown in FIG. 1, for illustrative purposes, a mixture of cylindrical pellets with at least one convexly-curved end face 18*a,* flat-cylindrical pellets 18*b,* and spherical pellets 18*c*. Considerations of symmetry, as well as tests carried out by the present inventor, indicate that the most effective pellet shape is cylindrical pellets with at least one convexly-curved end face 18*a*. Ceramic pellets are used as grinding media in size-reduction mills of various types, typically in tumbling mills, and are thus commercially available at a reasonable cost.

In the finished panel 14, pellets 18 are bound by the solidified molten material 16 in a plurality of superimposed rows 20. A majority of pellets 18 are each in contact with at least 4 adjacent pellets.

In operation, the panel 14 acts to stop an incoming projectile 12 in one of three modes: centre contact, flank contact, and valley contact, as described above.

Figure 2:
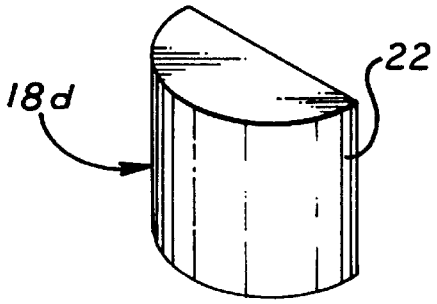
FIGS. 2 and 3 are perspective views of further pellet embodiments.

Referring now to FIG. 2, a further example of a pellet 18*d,* is depicted, said pellet having a regular, geometric, prismatic form, with one convex curved surface segment 22.

Figure 3:
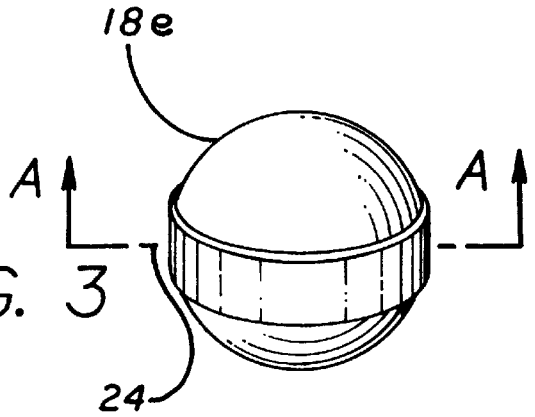

FIG. 3 shows a pellet 18*e* having a circular cross-section 24, taken at line AA. The pellet is of satellite form, and is commercially available.

FIG. 4 illustrates a multi-layered, armor panel 26. In referring to the following further figures, similar identification numerals are used for identifying similar parts.

An outer, impacting panel 28 of composite armor material is similar to panel 14 described above with reference to FIG. 1. Panel 28 acts to deform and shatter an impacting high velocity projectile 12. Light-weight armor for personal protection is made using a tough, yet hard, thermoplastic resin, for example, polycarbonate or acrylonite-butadiene-styrene.

An inner panel layer 30 is adjacent to outer panel 28, and is advantageously attached thereto. Inner panel 30 is made of a tough woven material, such as multiple layers of a tough, light aramid synthetic fiber sold under the trademark Kevlar®, or a polyethylene fiber material known by its trade name of Famaston. In a further embodiment, inner layer panel 30 comprises multiple layers of a polyamide netting. A further backing layer of aluminum may be utilized as shown in dashed line 31.

In operation, inner panel 30 causes asymmetric deformation of the remaining fragments 32 of the projectile 12, and absorbs remaining kinetic energy from these fragments by deflecting and compressing them in the area 34 seen in FIG. 1. It is to be noted that area 34 is much larger than the projectile cross-section, thus reducing the pressure felt on the inner side 36 of inner panel 30. This factor is important in personally-worn armor.

Referring now to FIG. 5, there is seen a casting mold 38, used for producing a composite armor material 10 as described above with reference to FIG. 1. The following elevated-temperature method of manufacture is used:

Step A:

A mold 38 is provided, having a bottom 40, two major surfaces 42, two minor surfaces 44 and an open top 46, wherein the distance between these two major surfaces 42 is 1.2 to 1.8 times the major axis of the pellets 18. For example, 8 mm pellets are used and the distance between major surfaces is 10 mm.

Step B:

Pellets 18 are inserted into mold 38 to form a plurality of superposed rows 20 of pellets 18, extending substantially along the entire distance between the minor side surfaces 44, and from the bottom 40 substantially to the open top 46.

Step C:

Mold 38 and the pellets 18 contained therein are incrementally heated, first to a temperature of about 100° C., and then further heated to a temperature of at least 100° C. above the flow point of the material to be poured in the mold. For example, aluminium has a flow point of about 540° C., and will require heating the mold, together with ceramic pellets contained therein, to above 640° C. Depending on the alloy being used, it has been found advantageous to heat the mold to a temperature of 850° C.

Step D:

Molten material 16, such as aluminum C443.2 ASTH B 85 or GBD-AlSi9Cu2 is poured into mold 38 to fill the same. A typical pour temperature range for aluminium is 830–900° C. Polycarbonate is poured at between 250–350° C. Advantageously, the surfaces of mold 38 are provided with a plurality of air holes 48, to facilitate the escape of air while molten material 16 is poured therein. During pouring, the pellets 18 are slightly rearranged in accordance with the hydrostatic and hydrodynamic forces exerted upon them by the molten material.

Step E:

Molten material 16 is allowed to solidify.

Step F:

Composite armor material 10 is removed from mold 38.

The following embodiment of a method of manufacture includes the use of an epoxy resin to form a themoset matrix. As is known, epoxies can be cast at room temperature and chemically hardened, or their hardening can be accelerated by the application of heat. Epoxy armor is suitable for use on aircraft. Yield strength and Young's modulus are both improved by adding fiber reinforcement.

Step A:

Mold 38 is provided, having a bottom 40, two major surfaces 42, two minor surfaces 44 and an open top 46, wherein the distance between the two major surfaces 42 is from about 1.2 to 1.8 times the major axis of the pellets 18.

Step B:

Pellets 18 are inserted into mold 38 to form a plurality of superposed rows 20 of pellets 18 extending substantially along the entire distance between the minor side surfaces 44, and from the bottom 40 substantially to the open top 46.

Step C:

Liquid epoxy resin is poured into mold 38 to fill the same.

Step D:

The epoxy is allowed to solidify.

Step E:

The composite armor material is removed from mold 38.

Referring to FIG. 6, there is illustrated a composite armor plate 50 for absorbing and dissipating kinetic energy from high velocity projectiles.

The plate is provided with a single internal layer of a plurality of high density ceramic bodies 52 bound and retained in panel form by a solidified material 54 such as epoxy. The bodies 52 are arranged in a plurality of adjacent rows wherein the pellets 52' along the edge of the plate are in direct contact with four adjacent pellets, while the internal pellets 52" are in direct contact with six adjacent pellets. The major axis M of the pellets 52 are substantially parallel to each other and perpendicular to the plate surface 56.

FIGS. 7*a* and 7*b* illustrate impact patterns and measured distances between impact points on two plates prepared according to the present invention and independently tested by Societe A.R.E.S., France.

Each plate had dimensions of 25×30 cm and a plurality of pellets substantially cylindrical in shape with at least one convexly curved end face, the diameter of each of said pellets being about 12.7 mm and the height of said pellets, including said convex end face, being about 11 mm, said pellets being bound in a plurality of adjacent rows by epoxy, the plate of FIG. 7*a* having an inner backing layer 12 mm thick, made of polyethylene fibers sold under the trademark Dyneema® and the plate of FIG. 7*b* having an inner backing layer 10 mm thick, made of Dyneema®. The first multi-layered armor panel had a weight of only 38.6 kg/m$^2$ and the second multi-layered armor panel had a weight of 33.6 kg/m$^2$.

The first panel was impacted by a series of three 7.62×51 PPI projectiles, fired at increasing velocities of 831.1 m/sec; 845.7 m/sec; and 885.8 m/sec at 0 elevation and at a distance of 13 m from the target.

None of the three projectiles, which were found to be within a triangular area having sides of only 5 cm, penetrated the panel.

The second panel was impacted by a series of four 7.62×51 PPI projectiles, fired sequentially at velocities of 783.7 m/sec; 800.2 m/sec; 760.5 m/sec; and 788.4 m/sec at 0 elevation and at a distance of 13 m from the target.

None of the four projectiles penetrated the panel, even though projectile 1 and 3 were found to be within only 3 cm from each other and projectile 4 was found to be within 7 cm from the sides of the panel, without causing damage thereto.

These tests clearly demonstrated the superior multi-impact properties of the composite armor plates of the present invention.

Table 1 is a reproduction of a test report relating to ballistic resistance tests carried out on a plate, having a plurality of pellets substantially cylindrical in shape with at least one convexly curved end face, the diameter of each of said pellets being about 19 mm and the height of said pellets, including said convex end face, being about 23 mm, said pellets being bound in a plurality of superposed rows by epoxy, and said plate having an inner backing layer 24 mm thick, made of Dyneema®. The entire multi-layered armor panel had a total weight of only 80.9 lbs.

As shown in Table 1, the ammunition used in the first and second test shots was 14.5 mm armor piercing B-32 bullets with increasingly higher values of average velocity, while the remaining test shots fired at the same 24×24 inch panel according to the present invention, were with a high-velocity, 20 mm fragment STM projectile. The first projectile was fired at a velocity of 3,303 feet per second, followed by a second 14.5 mm armor piercing projectile sequentially fired at a velocity of 3,391 feet per second, followed by two 20 mm fragment STM projectiles fired at average velocities of 4,333 and 4,437 ft/sec, respectively, and only this fourth projectile penetrated the panel, which had already sustained 3 previous hits.

TABLE 1

| | | | | |
|---|---|---|---|---|
| Date Rec'd: | 6/18/97 | H. P. WHITE LABORATORY, INC. | Job. No.: | 7403-01 |
| via: | HAND CARRIED | DATA RECORD | Test Date: | 6/19/97 |
| Returned: | HAND CARRIED | BALLISTIC RESISTANCE TESTS | Customer: | I.B.C. |

File (HPWLI): IBC-2.PIN

TEST PANEL

| | | | |
|---|---|---|---|
| Description: | PROPRIETARY | Sample No.: | ARRAY-1/TARGET-2 |
| Manufacturer: | PROPRIETARY | Weight: | 80.9 lbs. (a) |
| Size: | 24 × 24 in. | Hardness: | NA |
| Thicknesses: | na | Plies/Laminates: | NA |
| Avg. Thick.: | na in. | | |

AMMUNITION

| | | |
|---|---|---|
| (1): | 14.5 mm B-32 | Lot No.: |
| (2): | 20 mm Frag. Sim. | Lot No.: |
| (3): | | Lot No.: |
| (4): | | Lot No.: |

SET-UP

| | | | |
|---|---|---|---|
| Vel. Screens: | 15.0 ft. & 35.0 ft. | Range to Target: | 40.67 ft. |
| Shot Spacing: | PER CUSTOMER REQUEST | Range Number: | 3 |
| Barrel No./Gun: | 20–30 MM/14.5–1 | Backing Material: | NA |
| Obliquity: | 0 deg. | Target to Wit.: | 6.0 in. |
| Witness Panel: | .020" 2024-T3 ALUM. | Conditioning: | 70 deg. F. |

APPLICABLE STANDARDS OR PROCEDURES (1): PER CUSTOMER REQUEST
(2):
(3):

| Shot No. | Ammo. | Time s × 10–5 | Velocity ft/s | Time s × 10–5 | Velocity ft/s | Avg. Vel ft/s | Vel. Loss ft/s | Stk. Vel. ft/s | Penetration | footnotes |
|---|---|---|---|---|---|---|---|---|---|---|
| 1 | 1 | 605.3 | 3304 | 605.5 | 3303 | 3304 | 7 | 3297 | None | |
| 2 | 1 | 589.6 | 3392 | 589.8 | 3391 | 3392 | 7 | 3385 | None | |

TABLE 1-continued

| | | | | | | | | | |
|---|---|---|---|---|---|---|---|---|---|
| 3 | 2 | 481.5 | 4334 | 461.6 | 4333 | 4334 | 100 | 4234 | None |
| 4 | 2 | 450.8 | 4437 | 450.8 | 4437 | 4437 | 102 | 4335 | Bullet/Spall |

FOOTNOTES:
REMARKS:
Local BP = 29.88 in. Hg. Temp. = 72.0 F., RH = 69%
(a) WEIGHT DOES NOT INCLUDE 1.3 lbs. FOR SOFT WOVEN ARAMID COVER.

Table 2 is a reproduction of a test report relating to ballistic resistance tests carried out on a plate, having a plurality of pellets substantially cylindrical in shape with at least one convexly curved end face, the diameter of each of said pellets being about 19 mm and the height of said pellets, including said convex end face, being about 23 mm, said pellets being bound in a plurality of superposed rows by epoxy, and said plate having an inner layer backing 17 mm thick, made of Dyneema® and a further 6.35 mm thick backing layer of aluminum. The entire multi-layered armor panel had a total weight of only 78.3 lbs.

inch panel according to the present invention, were with 14.5 mm armor piercing B-32 bullets, with increasingly higher values of average velocity. The first projectile was a 20 mm fragment projectile, fired at a velocity of 4,098 feet per second, followed by seven 14.5 mm armor piercing projectiles sequentially fired at velocities from 2,764 to 3,328 feet per second. As will be noted, only at an average velocity of 3,328 ft/sec did the eighth armor piercing B-32 bullet penetrate the panel, which had already sustained 7 previous hits.

TABLE 2

| | | | | | |
|---|---|---|---|---|---|
| Date Rec'd: | 6/18/97 | H. P. WHITE LABORATORY, INC. | | Job. No.: | 7403-01 |
| via: | HAND CARRIED | DATA RECORD | | Test Date: | 6/19/97 |
| Returned: | HAND CARRIED | BALLISTIC RESISTANCE TESTS | | Customer: | I.B.C. |

File (HPWLI): IBC-1.PIN

TEST PANEL

| | | | |
|---|---|---|---|
| Description: | PROPRIETARY | Sample No.: | ARRAY-1/TARGET-1 |
| Manufacturer: | PROPRIETARY | Weight: | 78.3 lbs. (a) |
| Size: | 24.5 × 24.5 in. | Hardness: | NA |
| Thicknesses: | na | Plies/Laminates: | NA |
| Avg. Thick.: | na in. | | |

AMMUNITION

| | | |
|---|---|---|
| (1): | 20 mm Frag. Sim | Lot No.: |
| (2): | 14.5 mm B-32 | Lot No.: |
| (3): | | Lot No.: |
| (4): | | Lot No.: |

SET-UP

| | | | |
|---|---|---|---|
| Vel. Screens: | 15.0 ft. & 35.0 ft. | Range to Target: | 40.67 ft. |
| Shot Spacing: | PER CUSTOMER REQUEST | Range Number: | 3 |
| Barrel No./Gun: | 20–30 MM/14.5–1 | Backing Material: | NA |
| Obliquity: | 0 deg. | Target to Wit.: | 6.0 in. |
| Witness Panel: | .020" 2024-T3 ALUM. | Conditioning: | 70 deg. F. |

APPLICABLE STANDARDS OR PROCEDURES (1): PER CUSTOMER REQUEST
(2):
(3):

| Shot No. | Ammo. | Time s × 10–5 | Velocity ft/s | Time s × 10–5 | Velocity ft/s | Avg. Vel ft/s | Vel. Loss ft/s | Stk. Vel. ft/s | Penetration | footnotes |
|---|---|---|---|---|---|---|---|---|---|---|
| 1 | 1 | 487.8 | 4100 | 488.0 | 4098 | 4099 | 95 | 4004 | None | |
| 2 | 2 | 723.5 | 2764 | 723.7 | 2764 | 2764 | 7 | 2757 | None | |
| 3 | 2 | 715.8 | 2794 | 716.1 | 2793 | 2794 | 7 | 2787 | None | |
| 4 | 2 | 714.1 | 2801 | 714.4 | 2800 | 2800 | 7 | 2793 | None | |
| 5 | 2 | 703.9 | 2841 | 704.1 | 2840 | 2840 | 7 | 2833 | None | |
| 6 | 2 | 653.1 | 3062 | 653.2 | 3062 | 3062 | 7 | 3055 | None | |
| 7 | 2 | 640.1 | 3124 | 640.3 | 3124 | 3124 | 7 | 3117 | None | |
| 8 | 2 | 600.8 | 3329 | 601.0 | 3328 | 3328 | 7 | 3321 | Bullet/Spall | |

FOOTNOTES:
REMARKS:
Local BP = 29.88 in. Hg. Temp. = 72.0 F., RH = 69%
(a) WEIGHT DOES NOT INCLUDE 1.3 lbs. FOR SOFT WOVEN ARAMID COVER.

As shown in Table 2, the ammunition used in the first test shot was a high-velocity, 20 mm fragment STM projectile, while the remaining test shots fired at the same 24.5×24.5

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A composite armor plate for absorbing and dissipating kinetic energy from high velocity, armor-piercing projectiles, said plate consisting essentially of a single internal layer of high density ceramic pellets which are directly bound and retained in plate form by a solidified material such that the pellets are bound in a plurality of adjacent rows, wherein the pellets have an $Al_2O_3$ content of at least 93% and a specific gravity of at least 2.5, the majority of the pellets each have at least one axis of at least 12 mm length., said one axis of substantially all of said pellets being in substantially parallel orientation with each other and substantially perpendicular to an adjacent surface of said plate, and wherein a majority of each of said pellets is in direct contact with six adjacent pellets and said solidified material and said plate are elastic.

2. A composite armor plate according to claim 1, wherein the majority of said pellets each have at least one axis having a length in the range of from about 12 to 40 mm and the weight of said plate does not exceed 185 $kg/m^2$.

3. A composite armor plate as claimed in claim 1, wherein the majority of said pellets each has a major axis in the range of from about 20 to about 30 mm.

4. A composite armor plate as claimed in claim 1, wherein said pellets are of a regular geometric form, having at least one convex curved surface segment.

5. A composite armor plate as claimed in claim 1, wherein said pellets have at least one circular cross-section.

6. A composite armor plate as claimed in claim 1, wherein said pellets are of round, flat-cylindrical or spherical shape.

7. A composite armor plate as claimed in claim 1, wherein each of a majority of said ceramic pellets along an edge of the plate is in direct contact with four adjacent pellets, while internal pellets in said plurality of rows within said plate are in direct contact with six adjacent pellets.

8. A composite armor plate as claimed in claim 1, wherein said pellets have a hardness of at least 9 on the Mohs scale.

9. A composite armor plate as claimed in claim 1, wherein said solidified material contains at least 80% aluminium.

10. A composite armor plate as claimed in claim 1, wherein said solidified material is a thermoplastic resin.

11. A composite armor plate as claimed in claim 1, wherein said solidified material is an epoxy.

12. A multi-layered armor panel, comprising:

an outer, impact-receiving panel of composite armor plate according to claim 1, for deforming and shattering an impacting high velocity, armor-piercing projectile; and an inner layer adjacent to said outer panel, comprising a second panel of tough woven textile material for causing an asymmetric deformation of the remaining fragments of said projectile and for absorbing the remaining kinetic energy from said fragments, wherein said multi-layered panel is adapted to stop three projectiles fired sequentially at a triangular area of said multi-layered panel wherein the height of said triangle is substanially equal to three times the axis of said pellets.

13. A multi-layered, armor panel according to claim 12, wherein said second panel is made of polyethylene fibers.

14. A multi-layered, armor panel according to claim 12, wherein said second panel is made of aramide synthetic fibers.

15. A multi-layered, armor panel according to claim 12, wherein said inner layer comprises multiple layers of a polyamide netting.

16. A multi-layered, armor panel according to claim 12, comprising a further backing layer of aluminum.

* * * * *